US009551126B1

(12) United States Patent
Schmall

(10) Patent No.: US 9,551,126 B1
(45) Date of Patent: Jan. 24, 2017

(54) METHODS OF INHIBITING SUBTERRANEAN GROUNDWATER FLOW THROUGH AN OPENING IN FROZEN SOIL

(71) Applicant: Moretrench American Corporation, Rockaway, NJ (US)

(72) Inventor: Paul Schmall, Basking Ridge, NJ (US)

(73) Assignee: Moretrench American Corporation, Rockaway, NJ (US)

( * ) Notice: Subject to any disclaimer, the term of this patent is extended or adjusted under 35 U.S.C. 154(b) by 361 days.

(21) Appl. No.: 14/178,449

(22) Filed: Feb. 12, 2014

(51) Int. Cl.
*E02D 19/16* (2006.01)
*E02D 3/12* (2006.01)

(52) U.S. Cl.
CPC ..... *E02D 3/12* (2013.01); *E02D 19/16* (2013.01)

(58) Field of Classification Search
CPC ..... E02D 3/12; E02D 5/46; E02D 19/16; C09K 17/00; C09K 17/14
USPC ..... 405/267, 269, 270; 166/288, 292, 293
See application file for complete search history.

(56) References Cited

U.S. PATENT DOCUMENTS 4,799,549 A * 1/1989 Vinot ..... C09K 8/5045 106/803
4,874,641 A * 10/1989 Kittle ..... B08B 17/00 106/122
5,372,462 A * 12/1994 Sydansk ..... B09C 1/00 166/294
5,462,390 A * 10/1995 Sydansk ..... C09K 8/38 405/264
2007/0181041 A1* 8/2007 Kanazawa ..... C04B 7/21 106/715
2010/0044042 A1* 2/2010 Carter, Jr. ..... B09B 1/00 166/288
2010/0189893 A1* 7/2010 Vitale ..... C09K 17/22 427/206
2010/0232881 A1* 9/2010 Carter, Jr. ..... E02D 31/02 405/55

* cited by examiner

*Primary Examiner* — Frederick L Lagman
(74) *Attorney, Agent, or Firm* — BudzynFortunato IP Law, LLC

(57) ABSTRACT

Methods are provided of inhibiting subterranean groundwater flow through a window in frozen soil including (i) introducing at least one conductor having at least one discharge aperture in proximity to the window; and (ii) discharging a grout material including C-18 alpha olefin or a combination of C-16 alpha olefin and C-18 alpha olefin in a flowable state from the at least one conductor, wherein the grout material, upon being discharged, permeates into surrounding soil materials generally without displacement thereof and wherein the grout forms a barrier to inhibit subterranean groundwater flow through the window.

20 Claims, 6 Drawing Sheets

METHODS OF INHIBITING SUBTERRANEAN GROUNDWATER FLOW THROUGH AN OPENING IN FROZEN SOIL

FIELD OF THE INVENTION

This invention provides methods of inhibiting subterranean groundwater flow through an opening in frozen soil using a grout material including C-18 alpha olefin or a combination of C-16 alpha olefin and C-18 alpha olefin.

BACKGROUND OF THE INVENTION

A major concern with construction work zones such as shafts is the control of groundwater particularly at the junction of water-bearing soils and the underlying rock. Considerable efforts have been made to find means for satisfactorily reducing or minimizing soil erosion when excavation proceeds through such a junction.

Many geotechnical construction techniques exist for forming subterranean barriers that provide a groundwater cutoff and/or supporting excavation for a work zone. These techniques include installing sheet pile walls, cement/soil bentonite slurry trench cut off walls, concrete slurry walls, soil mixed walls, permeation grouted barriers, jet grouted barriers and artificial ground freezing walls (freeze walls).

At certain construction or excavation sites, digging must be conducted sufficiently deep where groundwater is encountered. When no barrier is provided to the groundwater flow, excavation below the groundwater table will result in ground subsidence and flooding of the excavation site. Artificial ground freezing is a technique where a perimetrical artificially frozen wall is created about the excavation site to act as a barrier against groundwater flow into the excavation site. With reference to FIGS. 1-2, an excavation site 10 is shown which extends through the waterbearing strata (zone) 12. The waterbearing strata are formed of soil and rock materials with varying permeability therein prior to freezing of the ground. To achieve artificial ground freezing, a plurality of freeze pipes 14 are disposed about the excavation site 10, prior to excavation. The freeze pipes 14, depending on the specific application, may be provided with sufficient length to extend to or into bedrock 16. Groundwater flow passes through soil material 18 which is located within the groundwater table 12 above the bedrock 16 which is assumed (generally) to provide an impervious barrier to groundwater flow. As such, there are minimal concerns with groundwater flow below frozen ground 26.

The freeze pipes 14 form a continuous circulating path for chilled brine which has a freezing temperature below that of water. A refrigeration unit 20 is provided on-site which allows for the chilling of the brine and pumping thereof through the freeze pipes 14. To artificially freeze the ground, particularly the soil material 18, the chilled brine is continuously passed through the freeze pipes 14. With reference to FIG. 2, with passage of an initial period of time, such as three weeks, some freezing 22 of the soil material 18 located about the freeze pipes 14 is achieved. With passage of additional time, such as six weeks, additional freezing occurs such that a continuous frozen barrier 24 may be defined about the freeze pipes 14. With further passage of time (e.g., 12 weeks), a solid robust barrier of frozen ground 26 may be created which has sufficient thickness and strength to provide support for the excavation in addition to preventing flow of groundwater therethrough. With a sufficiently robust barrier being formed, work may be performed at the excavation site 10 within the robust barrier 26 without ground subsidence or groundwater entering therein. The chilled brine is continuously pumped through the freeze pipes 14 to ensure that the robust barrier 26 is maintained during excavation.

It has been found that the soil material 18 may freeze at different rates. Several factors may contribute to this variation, including the rate of groundwater flow which may vary at different elevations in the soil material 18. In particular, a fairly rapid flow of groundwater may be difficult to freeze using artificial ground freezing techniques. To ensure that the soil material 18 is sufficiently frozen to permit excavation, temperature measurements are taken along the elevation of the soil material 18. For example, with reference to FIGS. 3A and 3B, isotherms "T" in the soil material 18 may be determined by measuring temperature at various locations about the freeze pipes 14. Where sufficient freezing has been achieved of the soil material 18 with negligible groundwater flow, the isotherms "T" define a fairly regular pattern as shown in FIG. 3A. However, with reference to FIG. 3B, where sufficient freezing has not been achieved, e.g., due to groundwater flow, the isotherms "T" about the freeze pipes 14 are distorted. As shown in FIG. 4, the isotherms "T" may be plotted vertically to evaluate the depth at which insufficient freezing may exist. Where a spot or area of insufficient freezing "A" is identified, an opening (so-called "window") may be located through the frozen wall through which groundwater may pass.

Moving groundwater is generally recognized as the most adversarial condition for ground freezing, resulting in freeze formation (closure) difficulties and, if undetected, freeze failures. Movement of groundwater during freeze formation puts an extra heat load on the freeze pipes and the refrigeration plant, preventing or requiring more time to achieve "closure" and a continuous frozen wall. Where the groundwater velocity is high, groundwater flowing past a single freeze pipe transfers the cooling effect downstream which, in plan view, results in an egg-shaped formation of frozen soil around the pipe, growing more slowly on the upstream side (FIG. 3B). Where the groundwater velocity is sufficiently high, groundwater flowing past a single freeze pipe introduces such a large amount of heat energy that growth of a frozen zone into the stream of the groundwater flow is inhibited.

Generally, a pre-freezing groundwater velocity (Darcy velocity) greater than 1 to 2 m/day may result in a freeze with window(s) which must be closed by other means. For example, via additional refrigeration effort with additional freeze pipes that employ chilled brine or the use of an alternate freezing agent (e.g., liquid nitrogen), reducing groundwater gradients, or most commonly, grouting to reduce the ground permeability.

Where groundwater velocity in excess of 1 to 2 m/day is suspected, periodic temperature profiling of the freeze pipes is performed by measuring the static and stabilized brine temperature approximately every 0.5 m within each of the freeze pipes. Anomalous warm spots may be an indication of a window in the freeze wall. However, as the temperature profiling is obtained from within the freeze pipes themselves, at the time a potential closure problem becomes evidence, the frozen wall will typically be on the order of 2 to 3 m thick with access to the location of the window limited by the presence of frozen ground. Hence, additional boreholes are drilled at least 3 m away from the alignment of the freeze pipes. In some instances, warm spots are well defined and the location of the window can be precisely located, although oftentimes, the window is not well defined and requires application of additional measures such as grouting to a broad area with a "shotgun" type of approach. In short, closure of a window in the freeze wall requires additional measures that not only delay construction but raise the cost associated therewith substantially.

Conventional permeation grouting techniques and materials have several shortcomings. Namely, the setting of conventional grouts (both cementitious and chemical) is significantly delayed at colder temperatures. This renders conventional grouts less effective as they permeate the soil and approach the colder temperatures at and near the window. Also, permeation grouting cannot be performed with a grout which consists of one or more individual components that have a relatively low freezing point as the grout may not set at the temperatures encountered in the window. Additionally, conventional permeation grouts that are aqueous suspensions or solutions and water soluble (e.g., cement-based grouts, silicate grouts and acrylate grouts) are susceptible to dilution by the groundwater flow. Also, such conventional permeation grouts can be adversely affected by groundwater chemistry.

Cementitious grout (e.g., cement grout with bentonite and other additives) is commonly used as it is readily available, easily mixed with standard equipment and the unit cost of material is low. Cementitious grout is pumped into surrounding soil material to form an auxiliary barrier against the groundwater flow and cause the window(s) in the frozen wall to be sealed from the groundwater flow. However, cementitious grout generates a heat of hydration which can be confused with the warmth of flowing groundwater, making it difficult to evaluate the conditions as the work proceeds. Further, the heat of hydration is counterproductive to freezing in that it introduces additional heat to the situation. Under sufficiently cold situations, the cementitious grout may freeze or set (or at least have components thereof set). With the discharge of the cementitious grout into the voids of the surrounding soil materials, slow or no setting may result in a discontinuous grout matrix. Moreover, the groundwater flow may cause non-set grout to wash away. In fact, the quantity of grout required for some projects indicate that in some instances the grout is most likely effective by altering the permeability of the surrounding groundwater regime rather than by directly plugging the window(s).

Thus, there is a need for improved methods of inhibiting subterranean groundwater flow through a window or opening in frozen soil.

SUMMARY OF THE INVENTION

The present invention provides methods of inhibiting subterranean groundwater flow through a window in frozen soil including (i) introducing at least one conductor having at least one discharge aperture in proximity to the window; and (ii) discharging a grout material including C-18 alpha olefin or a combination of C-16 alpha olefin and C-18 alpha olefin in a flowable state from the at least one conductor, wherein the grout material, upon being discharged, permeates into surrounding soil materials generally without displacement thereof and wherein the grout forms a barrier to inhibit subterranean groundwater flow through the window.

Advantageously, windows formed in frozen soil, such as openings formed in artificial ground freezing applications, may be in situ remediated. Desirably, the grout material acts as a plug in the window.

These and other features of the invention will be better understood through a study of the following detailed description and accompanying drawings.

DETAILED DESCRIPTION OF THE INVENTION

Figure 1:
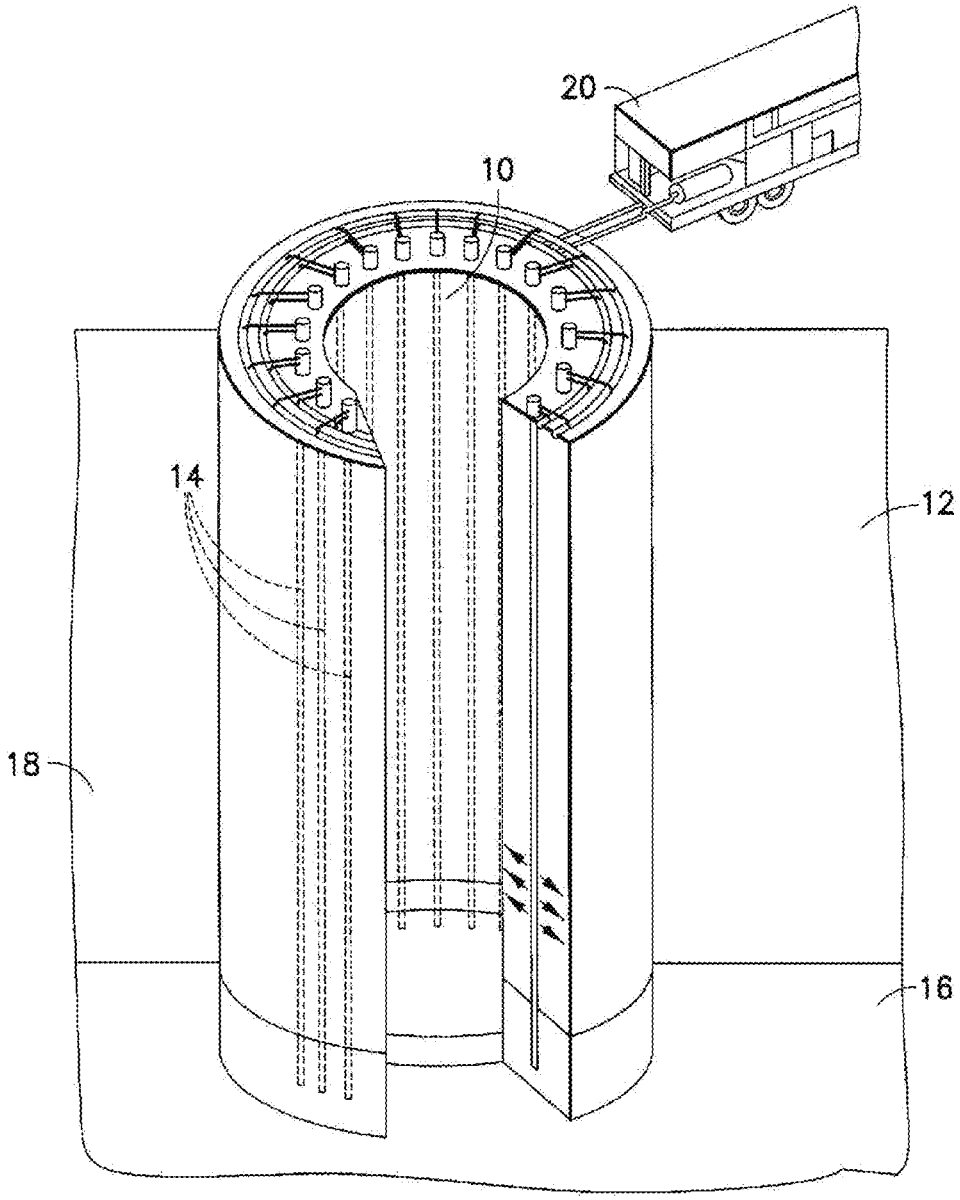
FIGS. 1-2 depict schematically the technique of artificial ground freezing.
Figure 2:
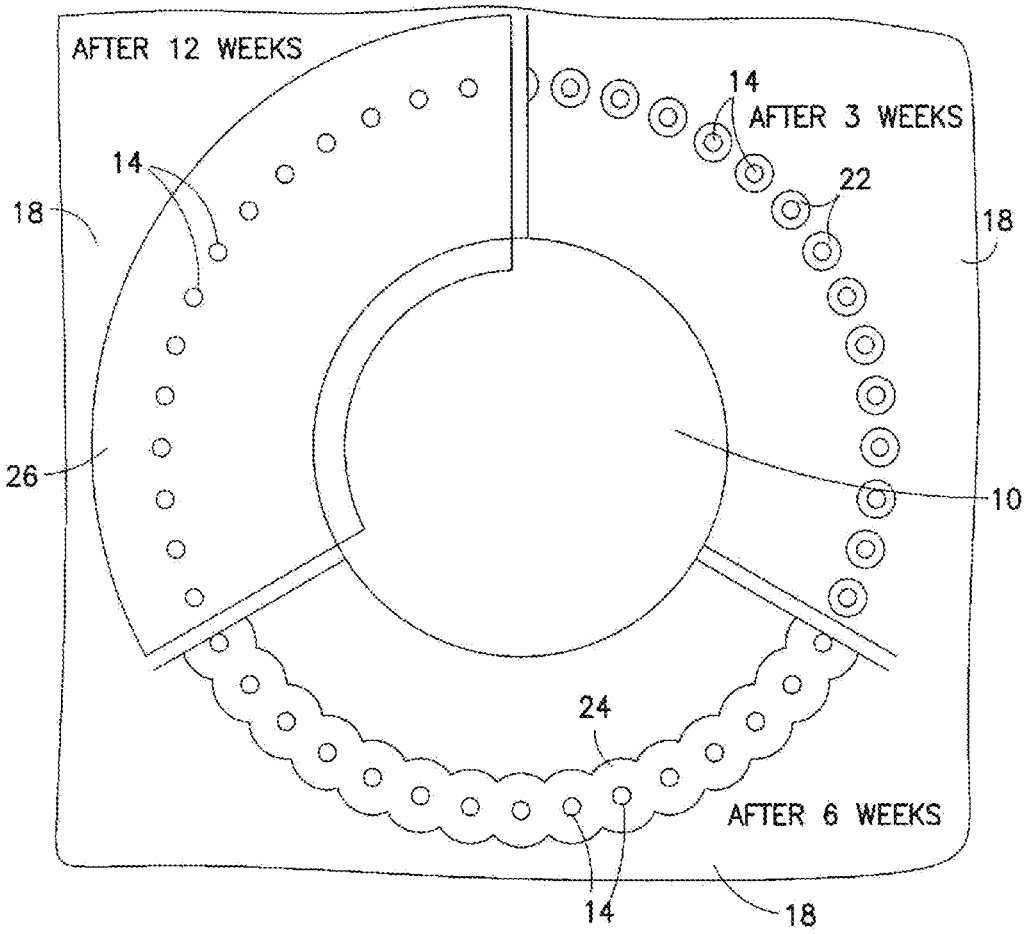
Figure 3A:
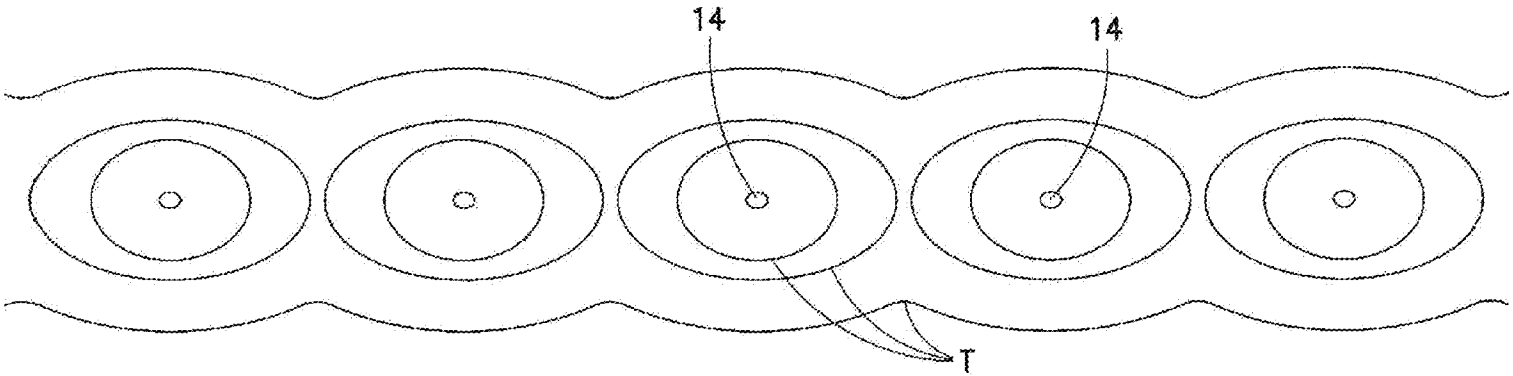
FIG. 3A depicts schematically isotherms which are formed about freeze pipes used in an artificial ground freezing application where groundwater flow is negligible.
Figure 3B:
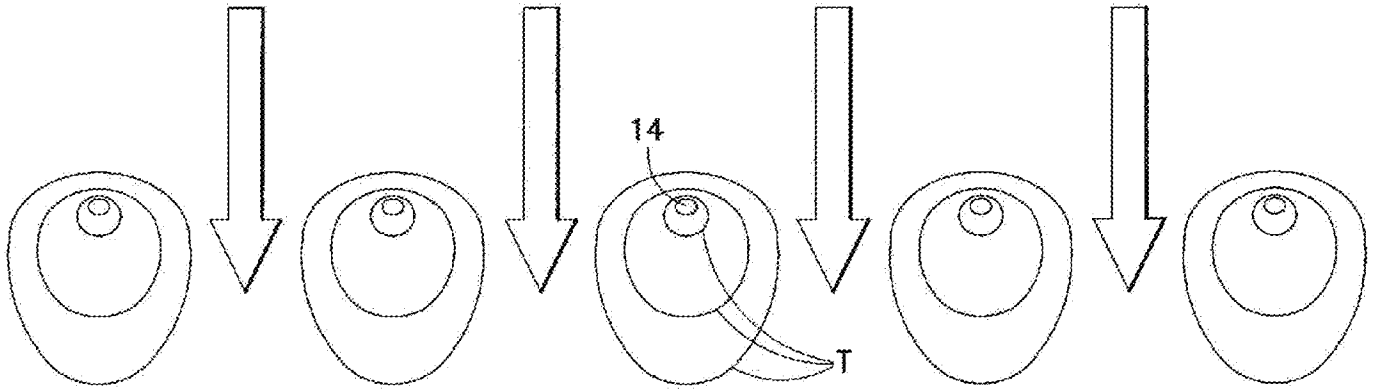
FIG. 3B depicts schematically isotherms which are formed about freeze pipes used in an artificial ground freezing application where groundwater flow is sufficiently high to be problematic.
Figure 4:
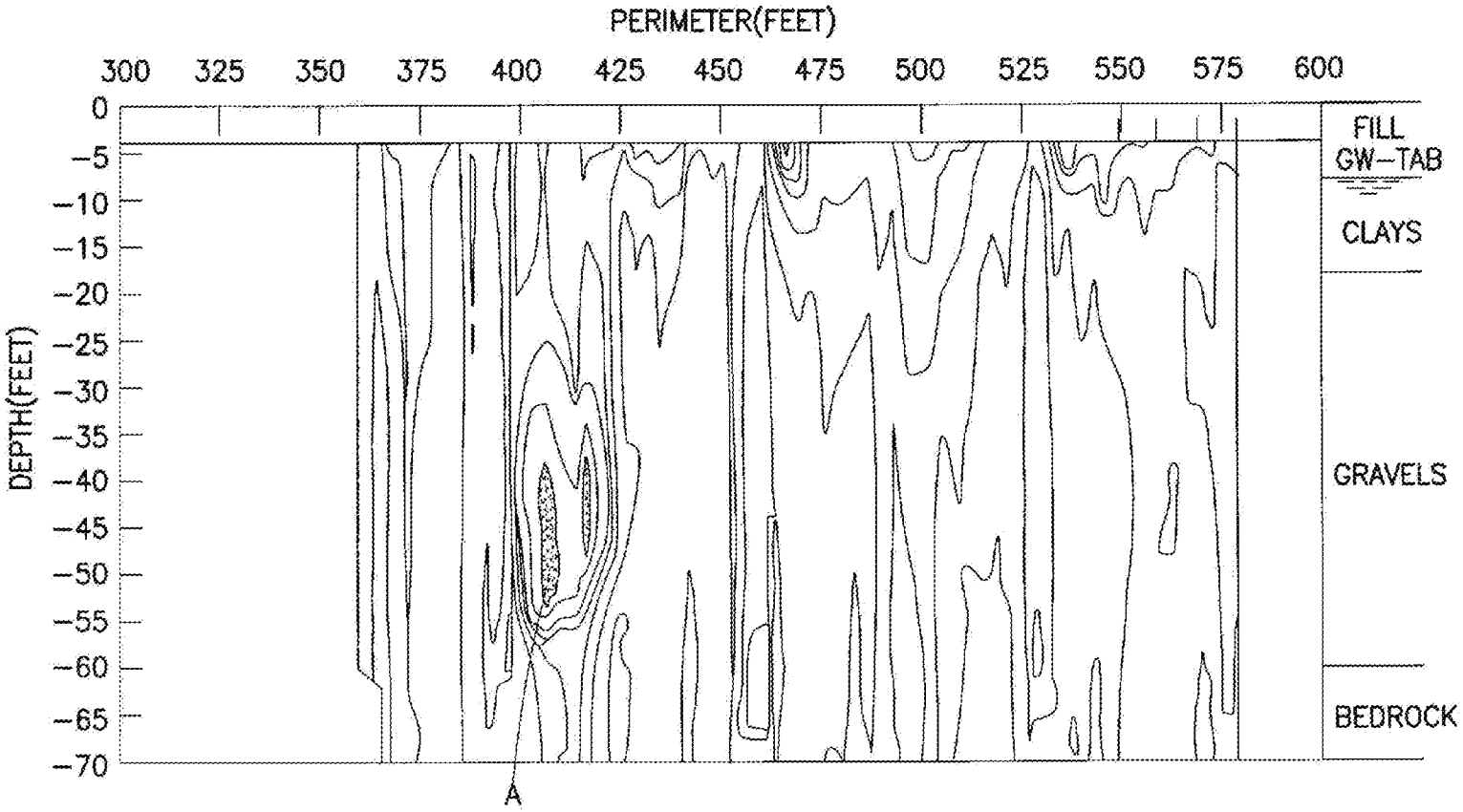
FIG. 4 is a profile about freeze pipes with isotherms showing potentially unfrozen areas of an artificially frozen ground barrier.

As used herein the following terms shall have the definitions set forth below.

As used herein, the term "set", and derivatives thereof, refers to becoming at least partially solidified and/or more viscous state, due to freezing, or partial freezing, of a material. A "set" material is considered a material which has sufficiently solidified or thickened to maintain its position in soil materials against flowing groundwater. "Setting" may involve a phase change from an initial state liquid state to a solid or semi-solid state. "Setting" may also involve a change in viscosity from an initial, low viscous state to a high viscosity state, resulting in a sufficiently thick liquid or slurry which can maintain position.

As used herein, the term "thermoplastic" refers to a material which "sets" when sufficiently cooled. The only change in the thermoplastic material in setting from a flowable state is a change of physical state (liquid to solid or semi-solid). No external chemicals, such as catalysts, are required. The thermoplastic material does not irreversibly set. In other words, when heated, the thermoplastic material may undergo a change in physical state from a solid or semi-solid state to a liquid state.

As used herein, the term "window" refers to an opening through which groundwater may pass due to insufficient freezing in an otherwise frozen wall.

As used herein, the term "cooling demand" refers to the amount of energy per unit volume of grout material that must be extracted from the grout material to transform it from its liquid, pumpable state, to a solidified (or semi-solidified) state at 0° C. The closer the freezing point of the grout material to 0° C., the lower the cooling demand. The baseline for the cooling demand is 0° C. because the grout material eventually (even after plugging the window) must be cooled at least below the melting point of frozen ground. This cooling demand takes into consideration three physical characteristics of the grout material; the melting (freezing) point, the specific heat, and the enthalpy of fusion. The cumulative effect of those three physical characteristics must be such that the grout material is more readily freezable than water (i.e., less heat needs to be withdrawn to freeze a unit volume of grout material than the same unit of volume of water). Cooling demand does not take into consideration the exothermic heat of reaction or heat of hydration of some grout materials, which is time dependent.

As used herein, the term "non-cementitious" refers to a material which is not cement-based or does not include cement as a component thereof.

The subject invention provides a method of inhibiting groundwater flow through a window in frozen soil. As will be appreciated by those skilled in the art, the invention herein may be applied to any frozen soil application. It is particularly well-suited for use with artificially frozen ground applications, particularly to form an auxiliary barrier within or outside of any windows formed in the frozen soil. The invention may have applicability in naturally frozen soil applications (e.g., openings in an extent of naturally frozen soil).

Figure 5:
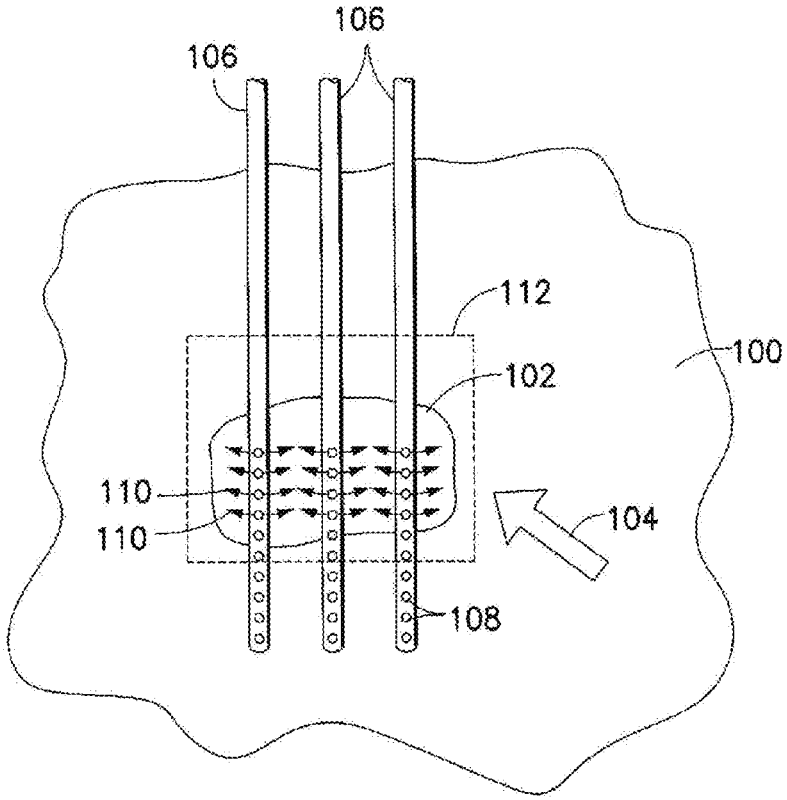
FIG. 5 shows application of a grout material to seal off an opening in frozen soil.

With reference to FIG. 5, an area of frozen soil 100 is depicted. The area 100 may be an isolated area or a portion of a continuous barrier. A window 102 is present in the area 100 through which groundwater flow passes as shown by arrow 104. The window 102 may be detected using any known technique.

To provide an auxiliary barrier for the area 100 against the groundwater flow as represented by the arrow 104, grout material is introduced in proximity to the window 102. At least one conductor 106 having at least one discharge aperture 108 formed therethrough for discharging grout material is introduced in proximity to the window 102. Conductors 106 are positioned to be in proximity to either or both sides of the window 102. Conductors 106 are generally pipe shaped with the grout material being forced therethrough under pressure. The grout material 110 is passed through the conductors 106 in a flowable state and discharged at a desired discharge depth. Known pumping techniques may be utilized in pumping the grout material 110 through the conductor 106. The discharge apertures 108 are aligned with the window 102 using known techniques, and grout material is forced through the discharge apertures 108 of the one or more conductors 106. In-pipe devices, such as packers, may be utilized to isolate particular discharge apertures 108 for administering grout. Grout material upon discharge, represented by arrows 110, is preferably caused to flow in various directions from the conductors 106 so as to define a continuous matrix 112, represented in dashed lines in FIG. 5, overlapping the window 102. It is preferred that a sufficient amount of the grout material 110 is provided to define the continuous matrix 112 with dimensions greater in both vertical and transverse directions so that the continuous matrix 112 extends fairly beyond the window 102.

In addition, ground temperature will vary based on various factors, including depth, groundwater flow, distance to frozen ground, and so forth. The temperature of the unfrozen ground in the immediate vicinity of the window 102 is typically slightly above 0° C. The capability of the grout material 110 to set at a temperature in the range of about 4° C. to about 18° C. allows the grout material 110 to penetrate sufficiently through the soil materials 114 prior to setting. Preferably, the grout material 110 does not generate heat in the process of setting. In one embodiment, the grout material 110 may set at a temperature above 0° C. The temperature at which the grout material 110 sets may be varied by adjusting by the ratio of C-16 alpha olefin to C-18 alpha olefin or inclusion of other additives therein.

Figure 6:
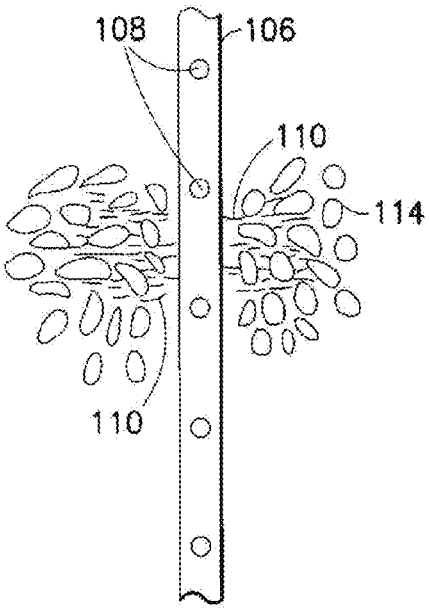
FIG. 6 shows a dispersion of grout material into soil materials without displacement thereof.

With reference to FIG. 6, it is preferred that the grout material 110 have relatively low viscosity during discharge to allow the grout material 110 to permeate into surrounding soil material without displacement thereof (such that heaving or lifting of the soil is avoided). With reference to FIG. 6, the conductor 106 is shown with the discharge apertures 108. Surrounding soil materials 114 are also shown with the grout material 110 (shown as dashed lines) being dispersed in voids defined in the soil materials 114. During introduction of the grout material 110, the arrangement of the soil materials 114 is generally not disturbed as the grout material 110 permeates thereinto.

In one embodiment, the grout material 110 has a dynamic viscosity in the range of 1-100 centipoise (cP) upon discharge from the conductor 106. The grout material 110 may have a dynamic viscosity greater than the viscosity of water (i.e., 1 cP). As such, the grout material 110 can permeate through typical soils in which naturally occurring groundwater velocities are observed to be excessive for closure of a frozen wall (e.g., gravel soil). In one embodiment, the grout material 110 has a dynamic viscosity in the range of 2 to 11 cP. Grout with such a viscosity can penetrate soils which are finer than gravels.

In one embodiment, the grout material 110 is discharged at a pressure less than the confining pressure applied to the soil materials 114 at discharge depth. The confining pressure is generated by soil materials overlying the soil materials 114 at discharge depth. By having a lesser pressure than the discharge depth confining pressure, the grout material 110 will generally not displace the soil materials 114. Any combination of the discharge viscosity and/or the discharge pressure discussed herein can be used to minimize soil displacement.

In one embodiment, the grout material 110 has a freezing point in the range of about 0° C. and about 18° C. In one embodiment, the grout material 110 has a freezing point in the range of about 4° C. and about 18° C.

In one embodiment, the grout material 110 has a total cooling demand of 50% or less as compared to water. In one embodiment, the grout material 110 has a total cooling demand of about 33% as compared to water.

Suitable thermoplastic materials for the grout material 110 include C-18 alpha olefin (octadecene) or a combination of C-16 alpha olefin (hexadecene) and C-18 alpha olefin. In one embodiment, the grout material 110 includes a combination of C-16 alpha olefin and C-18 alpha olefin having a ratio of C-16 alpha olefin to C-18 alpha olefin that ranges from 1:99 to 99:1, which may be to the exclusion of additives. In one embodiment, the grout material 110 includes a combination of C-16 alpha olefin and C-18 alpha olefin having a ratio of C-16 alpha olefin to C-18 alpha olefin that ranges from 10:90 to 90:10, which may be to the exclusion of additives. In one embodiment, the grout material 110 includes a combination of C-16 alpha olefin and C-18 alpha olefin having a ratio of C-16 alpha olefin to C-18 alpha olefin that ranges from 30:70 to 70:30, which may be to the exclusion of additives. In one embodiment, the grout material 110 includes a combination of C-16 alpha olefin and C-18 alpha olefin having a ratio of C-16 alpha olefin to C-18 alpha olefin of 50:50, which may be to the exclusion of additives.

Notably, C-16 alpha olefin has a freezing point of 3.9° C. whereas C-18 alpha olefin has a freezing point of 17.8° C. A combination of C-16 alpha olefin and C-18 alpha olefin has a freezing point between the freezing points of the two constituent materials. The freezing point for a mixture of C-16 alpha olefin and C-18 alpha olefin is equal to a weighted resultant based on the percentages of the two components in the mixture. For example, with a 50:50 mixture, the freezing point of C-16 alpha olefin and C-18 alpha olefin is a direct average of the freezing points of the two (i.e., about 10.8° C.). For other mixtures, for example, a 10:90 ratio, the freezing points of the two constituent components are weighed accordingly in determining a resultant freezing point in the range between the two freezing points. For example, with a 10:90 ratio of C-16 alpha olefin to C-18 alpha olefin, 90% of the range between the two freezing points is determined ((0.9×(17.8° C.−3.9° C.))=~12.5° C.) with this resultant being added to the low end freezing point to provide a weighted resultant freezing point of about 16.4° C. (3.9° C.+~12.5° C.=~16.4° C.) for the mixture. As a further example, with a 70:30 ratio of C-16 alpha olefin to C-18 alpha olefin, 30% of the range between the two freezing points is determined ((0.3×(17.8° C.−3.9° C.))=~4.2° C.) with this resultant being added to the low end freezing point to provide a weighted resultant freezing point of about 8.1° C. (3.9° C.+~4.2° C.=~8.1° C.) for the mixture. As will be recognized by those skilled in the art, by increasing the amount of C-18 alpha olefin present in a combination of C-18 alpha olefin and C-16 alpha olefin to greater than 50%, the freezing point of the combination can be increased above the 50:50 ratio freezing point of about 10.8° C. Conversely, by decreasing the amount of C-18 alpha olefin present in a combination of C-18 alpha olefin and C-16 alpha olefin to less than 50%, the freezing point of the combination can be decreased below the 50:50 ratio freezing point of about 10.8° C. It is understood that the freezing point of the grout will depend on the ratio of C-16 alpha olefin to C-18 alpha olefin as well as the presence of any additional materials therein. Likewise, the setting temperature of the grout will depend on the ratio of C-16 alpha olefin to C-18 alpha olefin as well as the presence of any additional materials therein.

The rate of setting of the grout material 110, e.g., so as to permit longer or shorter set time and thereby allow the grout material 110 to permeate deeper or less into the surrounding soil materials 114, may be adjusted by adjusting the freezing point of the grout material 110. This may be desired where further or lesser extents of permeation of the grout material 110 into the soil materials 114 is desired before setting. Sufficient cooling of the grout material 110 causes the setting thereof.

The grout material 110 may be initially heated prior to or during discharge from the conductors 106. For example, the grout material 110 may be heated to at least 30° C. above the freezing point of the grout material 110. In one embodiment, the grout material 110 has a boiling point above the boiling point of water (100° C.) so that the grout material 110 may be safely heated with steam or boilers in the field, if necessary.

Heating the grout material 110 facilitates the maintenance of the grout material in a flowable state through the conductors 106 and discharge into the soil materials 114. The soils and groundwater cool the grout material 110 upon discharge causing it to solidify. Any known technique for applying heat may be utilized and heat may be applied prior to loading the grout material 110 into the conductors 106 and/or along one or more portions of the conductors 106.

It is noted that after discharge, the grout material 110 sets as discussed above. Any additional agents, fillers, surfactants, set retarders, emulsifiers, are entrapped in the principal material as it sets. The additional agents preferably do not chemically react with the principal material in setting.

In one embodiment, the grout material is non-cementitious. In one embodiment, the grout material is resistant to dilution or washout by flowing water. In one embodiment, the grout material is immiscible in water. Due to the in-ground use and exposure to groundwater, it is preferred that all components of the grout material 110 be environmentally-friendly and not toxic to animal or plant life.

EXAMPLES

Comparative Examples

Chemically-Setting Conventional Grouts

A variety of chemically-setting conventional grout materials were assessed for viscosity, cooling demand and dilution resistance with respect to groundwater. Namely, cement-based grout, sodium silicate grout, acrylate grout and polyurethane grout.

Portland cement-based grouts have a viscosity that can be controllably varied from 10 cP to greater than 1000 cP depending on the mixture of components. The cooling demand of such grouts is greater than water with a heat of hydration (i.e., exothermic reaction) that makes evaluating the field temperature data problematic. Further, despite the addition of anti-washout agents which improve washout behavior, these aqueous suspensions cannot be modified to the point of immiscibility.

Silicate grouts can be mixed with a number of reactants to form gels with various strengths, permanence and reaction times. Commonly, salts or organic esters are used as reactants. Typically, the mixed viscosity of sodium silicate grouts varies from 20 to 55 cP. The cooling demand of such grouts is greater than water. As an aqueous solution, dilution under flowing water conditions is problematic. Set times are somewhat uncontrollable and vary from immediate to several hours and are highly temperature dependent. Organic reactants, which provide more control over set time, have freezing points lower than water. With decreasing temperatures, the set times are significantly prolonged.

Acrylate grouts vary in consistency once set depending on the water content from gel-like to hard and brittle. The viscosity of acrylate grouts is near that of water. The cooling demand of such grouts is greater than water. Acrylate grouts are water soluble and thus, susceptible to dilution. Additionally, some components of acrylate grouts have freezing points well below the freezing point of water. Set times are relatively short (10 seconds to 2 hours) but temperature dependent. Cooler temperatures will result in extended setting times.

Polyurethane grouts are not an aqueous solution or suspension but are produced by reacting a polyisocyanate with a polyol or other chemicals which have hydroxyl groups (e.g., polyethers, polyesters or glycols). A foam structure is produced by the reaction of the resultant product with water. Although water is a necessary component in the formation of the polymer, water is not a component of the raw grout material. The lowest viscosity polyurethane grouts have a relatively high viscosity of 50 to 100 cP plus slower set times at temperatures approaching 0° C. Further, the chemical reaction of polyurethane grouts requires a minimum enthalpy which increases with pressure. As such, the cooling demand of the polyurethane grout is dictated by its specific heat, rather than an enthalpy of fusion. In fact, it is recommended that polyurethane grouts be injected at temperatures above 13° C. otherwise the resin viscosity and set time will be affected such that the grout will fail to penetrate and react. Additionally, the chemical reaction of polyurethane grouts is exothermic which is counterproductive to the desired freezing. Also, although polyurethane grouts are resistant to dilution, some polyurethane grouts contain toxic and possibly mutagenic or carcinogenic substances.

In summary, Portland cement-based grout, silicate grout and acrylate grout have increased set times at colder temperatures. Additionally, polyurethane grout has questionable reactivity with setting at temperatures approaching 0° C. plus unacceptable viscosity.

Comparative Examples

Thermoplastic Materials

Thermoplastic materials set in a temperature-dependent manner that does not require a chemical reaction. A variety of previously documented thermoplastic materials were assessed for freezing point, viscosity, cooling demand and dilution resistance with respect to groundwater. Namely, bitumen, paraffin waxes and low density polyethylene (LDPE).

Hot bitumen has been used to seal off major seepage through dams and in deep rock tunnels. As the hot bitumen comes in contact with water, it is cooled rapidly and congeals. Notably, the freezing point of bitumen is about 180° C. which is relatively high. Bitumen can range in viscosity between 15 and 100 cP. However, bitumen must be heated to 180° C. to 225° C. to achieve such a sufficiently low viscosity plus the injection pipes themselves must also be heated full length to ensure injectability of the bitumen into the ground. Not only is the heating required for the injection of bitumen counterproductive to the goal of forming a frozen wall but the cooling demand required for bitumen is unacceptably high. Desirably, bitumen is dilution resistant as it is immiscible in water.

Paraffin waxes have been used for environmental encapsulation. In particular, WAXFIX and Montan paraffin waxes have been studied for the encapsulation of environmental waste. Notably, the freezing point of paraffin wax is in the range of 50° C. to 95° C. which is relatively high. As such, the cooling demand of paraffin wax is also relatively high. When melted at temperatures generally in excess of 50° C., paraffin waxes have relatively low viscosities in the range of 5 to 7 cP at 70° C. Desirably, paraffin wax is dilution resistant as it is immiscible in water. Notably, commercially available refined paraffin waxes typically consist of 80 to 90% straight-chain hydrocarbons (alkanes) with an average chain length of 20 to 30 carbon atoms. In particular, WAXFIX is a "fully refined" paraffin wax composed primarily of alkanes in the C-18 to C-25 range with a small amount of proprietary additives to enhance its handling properties as a grout. In contrast, Montan wax is derived by solvent extraction of lignite or brown coal and is a mixture of long chain esters, acids, alcohols and ketones with carbon numbers generally between 24 and 30.

Low Density Polyethylene (LDPE) has also been considered for environmental encapsulation of environmental waste. For example, Marcus 4040 is a polyethylene material used as a grout material. Notably, the freezing point of LDPE is about 58° C. which is relatively high. As such, the cooling demand of LDPE is also relatively high. Further, the viscosity of molten LDPE is also relatively high (i.e., 70 cP) which limits is ability to penetrate soils. Desirably, LDPE is dilution resistant as it is immiscible in water.

Additionally, mineral oil and other petroleum waxes (i.e., microcrystalline waxes, petrolatums and "foots oil") derived from the distillation of crude oil have been considered as possible grouts. However, mineral oil typically has a freezing point between −12° C. and −18° C. which is impractical. Likewise, the quality of other petroleum waxes derived from the distillation of crude oil varies as does the consistency of physical properties exhibited therefrom. Also, due to the variability in composition, the wide temperature range over which such petroleum waxes liquefy or set is unfavorable for use as a grout. Plus, "foots oil" has a relatively high freezing point and thus, has a relatively high cooling demand.

Examples

Alpha Olefin Based Grouts

In contrast to mineral oil and petroleum waxes which are a mixture of compounds derived from the distillation of crude oil, alpha olefins are synthetic waxes readily available as a single compound. As such, alpha olefins have a consistent and well defined freezing point as well as predictable viscosity at a given temperature which is desirable for application as a grout material.

C-16 alpha olefin and C-18 alpha olefin, as well as combinations thereof, e.g., a 50:50 ratio, were examined for their suitability as grouts. Namely, the freezing point, viscosity, cooling demand and resistance to dilution with respect to groundwater were assessed.

C-16 alpha olefin and C-18 alpha olefin have a freezing point of 3.9° C. and 17.8° C., respectively, and a viscosity of 4.0 and 5.1 cP, respectively. At 0° C., these alpha olefins have the consistency of a soft wax whereas at room temperature they are oils. Notably, C-16 alpha olefin has a specific gravity of 0.785 whereas C-18 has a specific gravity of 0.793. Additionally, neither C-16 alpha olefin nor C-18 alpha olefin are water soluble; thus, C-16 alpha olefin and C-18 alpha olefin are resistant to dilution by groundwater. Also, both C-16 alpha olefin and C-18 alpha olefin are environmentally friendly and non-toxic, thus, not harmful to animal or plant life.

Figure 7:
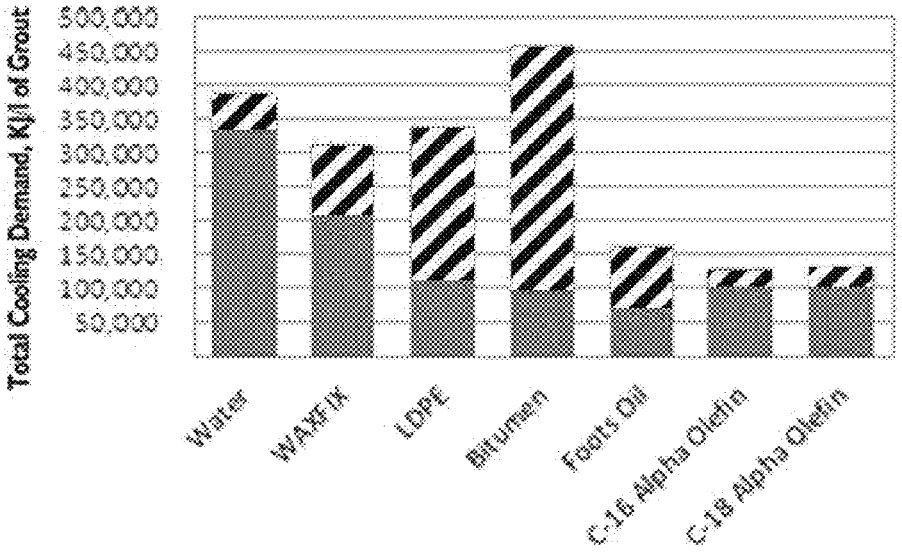
FIG. 7 is a bar graph of the total cooling demand of various thermoplastic materials as compared to water. In particular, the total cooling demand for various grout materials was calculated based on the energy associated with phase change (shaded), plus the energy associated with cooling the grout material from its likely injection temperature at its melting point or ambient temperature, whichever is higher down to 0° C. (striped black). Water and C-16 alpha olefin were considered at an initial temperature of 13° C. (typical ambient groundwater temperature) while other materials were each considered at an initial temperature of about their respective melting point.

As reflected in FIG. 7, the total cooling demand of each of C-16 alpha olefin and C-18 alpha olefin is about one third that of water. In comparison, the total cooling demand of comparative thermoplastic materials WAXFIX, LDPE, bitumen and foots oil is greater than that of either C-16 alpha olefin and C-18 alpha olefin. As such, both C-16 alpha olefin and C-18 alpha olefin can be each cooled with relatively low removal of energy. This allows for rapid setting. By adjusting the freezing point of the grout 110, the setting of the grout 110 may be controlled relatively well with respect to a target window. In other words, the freezing temperature of the grout 110 may be selected based on characteristics of the target window, e.g., adjacent temperature, size of coverage needed, etc., to control proper setting. With relatively low total cooling demand, the grout 110 may have a freezing point selected slightly above a target temperature based on the target window characteristics. With various possible window characteristics, adjustment of the freezing point allows for configured grout to be prepared for a particular application.

What is claimed is:

1. A method of inhibiting subterranean groundwater flow through a window in frozen soil comprising:

introducing at least one conductor having at least one discharge aperture in proximity to the window; and discharging a grout material comprising a combination of C-16 alpha olefin and C-18 alpha olefin in a flowable state from the at least one conductor, wherein the grout material, upon being discharged, permeates into surrounding soil materials generally without displacement thereof and wherein the grout forms a barrier to inhibit subterranean groundwater flow through the window.

2. The method of claim 1, wherein the grout material sets at a ground temperature in the range of about 0° C. to about 18° C.

3. The method of claim 1, wherein the grout material has a freezing point in the range of about 4° C. to about 18° C.

4. The method of claim 1, wherein the grout material has a dynamic viscosity in the range of 2-11 cP at a temperature above its freezing point.

5. The method of claim 1, wherein the grout material is discharged from the conductor at a pressure less than the confining pressure applied to the surrounding soil materials.

6. The method of claim 1, wherein the combination of C-16 alpha olefin and C-18 alpha olefin is present at a ratio in the range of from 1:99 to 99:1.

7. The method of claim 1, wherein the combination of C-16 alpha olefin and C-18 alpha olefin is present at a ratio in the range of from 10:90 to 90:10.

8. The method of claim 1, wherein the combination of the C-16 alpha olefin and the C-18 alpha olefin is present at a ratio in the range of from 30:70 to 70:30.

9. The method of claim 1, wherein the combination of the C-16 alpha olefin and C-18 alpha olefin is present at a ratio of 50:50.

10. The method of claim 1, wherein the grout material has a dynamic viscosity greater than water.

11. The method of claim 1, wherein the grout material is a solid or semi-solid at 0° C.

12. The method of claim 1, wherein the grout material has a total cooling demand of 50% or less as compared to water.

13. The method of claim 1, wherein the grout material has a total cooling demand of about 33% as compared to water.

14. The method of claim 1, wherein the grout material is non-cementitious.

15. The method of claim 1, wherein the grout material is immiscible in water.

16. A method of inhibiting subterranean groundwater flow through a window in frozen soil comprising:

introducing at least one conductor having at least one discharge aperture in proximity to the window;

discharging a grout material comprising C-18 alpha olefin or a combination of C-16 alpha olefin and C-18 alpha olefin in a flowable state from the at least one conductor, wherein the grout material, upon being discharged, permeates into surrounding soil materials generally without displacement thereof and wherein the grout forms a barrier to inhibit subterranean groundwater flow through the window; and heating the grout material to at least 30° C. above its freezing temperature prior to discharge.

17. The method of claim 16, wherein the grout material sets at a ground temperature in the range of about 0° C. to about 18° C.

18. The method of claim 16, wherein the grout material has a freezing point in the range of about 4° C. to about 18° C.

19. The method of claim 16, wherein the grout material has a total cooling demand of 50% or less as compared to water.

20. The method of claim 16, wherein the grout material has a total cooling demand of about 33% as compared to water.

* * * * *